US012618293B2

(12) United States Patent
Barnett et al.

(10) Patent No.: US 12,618,293 B2
(45) Date of Patent: May 5, 2026

(54) PDC BIT ELEMENT WITH RETENTION FEATURE

(71) Applicant: Taurex Drill Bits, LLC, Norman, OK (US)

(72) Inventors: Samuel Barnett, Conroe, TX (US); Dustin Lyles, Norman, OK (US); Warren Dyer, Norman, OK (US); Blake Cameron Richnow, Magnolia, TX (US)

(73) Assignee: Taurex Drill Bits, LLC, Norman, OK (US)

( * ) Notice: Subject to any disclaimer, the term of this patent is extended or adjusted under 35 U.S.C. 154(b) by 0 days.

(21) Appl. No.: 18/734,032

(22) Filed: Jun. 5, 2024

(65) Prior Publication Data

US 2024/0401414 A1 Dec. 5, 2024

Related U.S. Application Data

(60) Provisional application No. 63/506,292, filed on Jun. 5, 2023.

(51) Int. Cl.
*E21B 10/573* (2006.01)

(52) U.S. Cl.
CPC ..... *E21B 10/573* (2013.01)

(58) Field of Classification Search
CPC ..... E21B 10/573
USPC ..... 175/432
See application file for complete search history.

(56) References Cited

U.S. PATENT DOCUMENTS

| | | | | |
|---|---|---|---|---|
| 4,553,615 | A * | 11/1985 | Grainger | E21B 10/62 175/354 |
| 7,703,559 | B2 * | 4/2010 | Shen | E21B 10/573 175/426 |
| 9,803,427 | B1 * | 10/2017 | Cooley | E21B 10/56 |
| 10,487,590 | B2 * | 11/2019 | Schroder | E21B 10/62 |
| 2007/0158115 | A1 * | 7/2007 | Sherwood | E21B 10/55 175/426 |
| 2010/0276145 | A1 * | 11/2010 | Dewey | E21B 10/46 166/55.6 |
| 2011/0297454 | A1 * | 12/2011 | Shen | E21B 10/633 175/431 |
| 2012/0273280 | A1 * | 11/2012 | Zhang | E21B 10/573 175/428 |
| 2015/0233188 | A1 * | 8/2015 | Wright, II | E21B 10/5735 175/62 |
| 2016/0290056 | A1 * | 10/2016 | Propes | E21B 10/573 |
| 2017/0335633 | A1 * | 11/2017 | Yu | E21B 10/633 |
| 2018/0274302 | A1 * | 9/2018 | Zhang | E21B 10/5673 |
| 2021/0293093 | A1 * | 9/2021 | Duffy | E21B 10/16 |
| 2023/0407709 | A1 * | 12/2023 | Clark | E21B 10/5735 |

* cited by examiner

*Primary Examiner* — Taras P Bemko
(74) *Attorney, Agent, or Firm* — Vorys, Sater, Seymour and Pease LLP

(57) ABSTRACT

A drill bit includes a bit body, one or more blades forming part of the bit body, a plurality of cutter pockets defined in the one or more blades, each cutter pocket providing a floor and an orifice defined in the floor, and a plurality of cutters secured to the one or more blades at the plurality of cutter pockets. Each cutter includes a substrate, a diamond table secured to the substrate at an interface, and a retention feature extending from a bottom surface of the substrate and sized to be received within the orifice of a corresponding one of the plurality of cutter pockets.

20 Claims, 3 Drawing Sheets

PDC BIT ELEMENT WITH RETENTION FEATURE

BACKGROUND

Wellbores for the oil and gas industry are commonly drilled by a process of rotary drilling. In conventional rotary drilling, a drill bit is mounted to the end of a drill string, which may be extended to reach a desired depth by progressively adding tubing segments on site while drilling. In some drilling configurations, a rotary table or top drive included on a drilling rig turns the drill string, including the drill bit arranged within the wellbore, to progressively penetrate the subterranean formation while drilling fluid is pumped through the drill string. In other drilling configurations, the drill bit may be rotated using a downhole mud motor arranged adjacent the drill bit in the downhole environment and powered, for example, using the circulating drilling fluid.

A common type of drill bit used to drill wellbores is known as a "fixed cutter" bit, which includes blades with cutters mounted thereon. As the drill bit rotates, and due to the alignment of the cutters positioned on the blades, the cutters make contact with the subterranean formation and deepen the wellbore by progressively shearing away layers of the subterranean rock.

Due to the hardness of the subterranean rock and the downhole drilling conditions to which the cutters are exposed, the cutters may dull or even evacuate (dislodge from) the body of the drill bit entirely. Oftentimes, the initial cutter installation is influential in extending the life of the cutter within the fixed-cutter blades.

Accordingly, an efficient means of cutter installation and cutter retention is desirable.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a drill bit is disclosed and includes a bit body, one or more blades forming part of the bit body, a plurality of cutter pockets defined in the one or more blades, each cutter pocket providing a floor and an orifice defined in the floor, and a plurality of cutters secured to the one or more blades at the plurality of cutter pockets. Each cutter includes a substrate, a diamond table secured to the substrate at an interface, and a retention feature extending from a bottom surface of the substrate and sized to be received within the orifice of a corresponding one of the plurality of cutter pockets.

According to another embodiment consistent with the present disclosure, a method of securing a cutter to a cutter pocket of a drill bit is disclosed and includes receiving the cutter in the cutter pocket, the cutter including a substrate, a diamond table secured to the substrate at an interface, and a retention feature extending from a bottom surface of the substrate. The method further includes centering the cutter within the cutter pocket by receiving the retention feature in an orifice defined in a floor of the cutter pocket, and attaching the cutter in the cutter pocket while the retention feature is received within the orifice.

According to another embodiment consistent with the present disclosure, a method of manufacturing a cutter for a drill bit is disclosed and includes securing a diamond table to a first end of a substrate, and providing a retention feature on a second end of the substrate opposite the first end. The retention feature comprises a cylindrical body sized to be received within an orifice defined in a floor of a cutter pocket of the drill bit.

According to another embodiment consistent with the present disclosure, a method of retrofitting a drill bit is disclosed and includes forming an orifice defined in a floor of a cutter pocket, and receiving a cutter in the cutter pocket, the cutter including a substrate, a diamond table secured to the substrate at an interface, and a retention feature extending from a bottom surface of the substrate. The method further includes centering the cutter within the cutter pocket by receiving the retention feature in the orifice, and attaching the cutter in the cutter pocket while the retention feature is received within the orifice.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Embodiments in accordance with the present disclosure generally relate to mounting cutters to fixed-cutter drill bits and, more particularly, to polycrystalline diamond compact (PDC) cutters that include retention features that help retain the cutters within corresponding pockets of the drill bit.

PDC cutters for fixed cutter drill bits (both tungsten and matrix) are typically brazed in place within their corresponding bit pockets. While drilling a wellbore, varying drilling conditions (e.g., flow rates, axial forces, heavy vibrations, erosion, etc.) can lead to PDC cutters evacuating (dislodging from) a manufactured bit pocket. Moreover, since brazing is largely a human process, there is potential for cutters to be lost due to impurities present during the brazing process and/or improper brazing procedures. When PDC cutters are lost during drilling operations, drill bits are often prematurely damaged, which can result in lost time due to bit trips or inefficient drilling, while also potentially causing costly damage to the drill bit and inhibiting the ability to repair the drill bit.

Embodiments of the present disclosure describe methods of mechanically retaining PDC cutters in their corresponding bit pocket, and thereby increasing drill bit durability and performance. More particularly, the retention features described herein help mitigate risk of lost cutters during drilling operations, and may also aid in ensuring the proper placement and centralization of the cutter within the fixed-cutter drill bit during installation. The retention features described herein may also ensure a successful brazing operation, where brazing is used to join cutters to the fixed-cutter drill bit during initial installation. Embodiments described herein limit risk exposure to damaged drill bits beyond repair.

Figure 1:
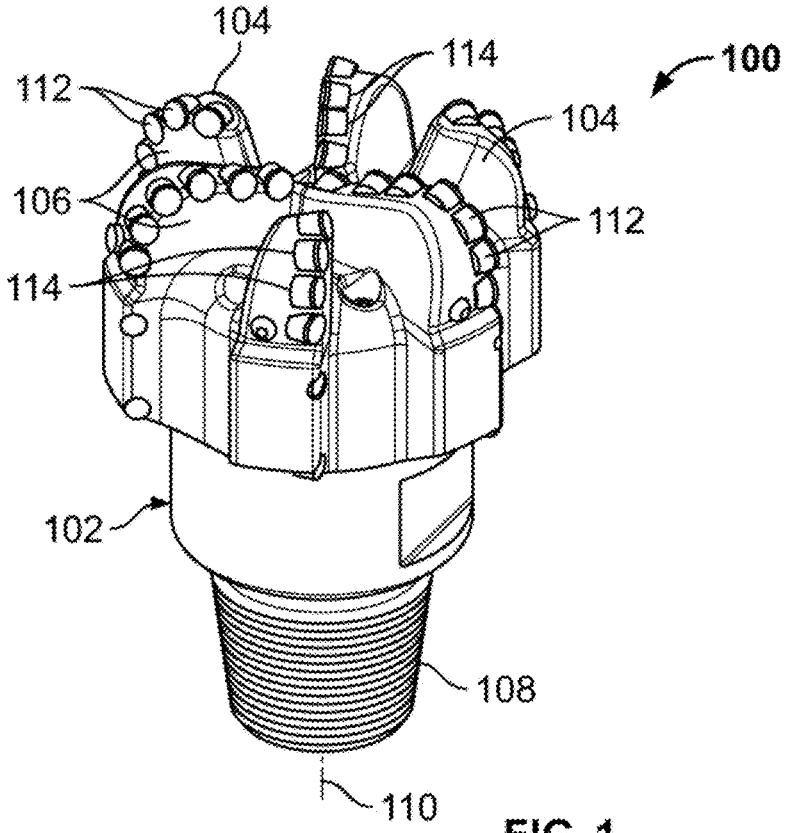
FIG. 1 is a schematic, isometric view of an example fixed-cutter drill bit that may incorporate the principles of the present disclosure.

FIG. 1 is a schematic, isometric view of an example fixed-cutter drill bit 100 that may employ the principles of the present disclosure. The fixed-cutter drill bit 100 (hereafter the "drill bit 100") has a bit body 102 that includes radially and longitudinally extending blades 104 having leading faces 106, and a threaded pin connection 108 for connecting the bit body 102 to a drill string (not shown). The bit body 102 may be made of steel or a metal matrix of a harder material, such as tungsten carbide. The bit body 102 is configured for rotation about a longitudinal axis 110 to drill into a subterranean formation via application of weight on the bit body 102. Those of ordinary skill in the art will be familiar with other prominent features of the drill bit 100 including, but not limited to, the shoulder, the nozzles (alternatively referred to as ports), the cone, the nose, etc. However, those features are beyond the scope of this disclosure and will not be discussed in any detail.

A plurality of cutters 112 are secured to the bit body 102 and, more particularly, to the blades 104. Each cutter 112 may be positioned within a corresponding cutter pocket 114 that is sized and shaped to receive the respective cutter 112. The cutters 112 are held in the blades 104 and corresponding cutter pockets 114 at predetermined angular orientations and radial locations to position the cutters 112 at a desired backrake angle against the formation being penetrated. As the bit body 102 is rotated, the cutters 112 are driven against and through the underlying rock formation by the combined forces of weight-on-bit and torque assumed at the drill bit 100.

During manufacture of the drill bit 100, the cutters 112 are secured (attached) within the pockets 114 by brazing, which is a well-known method of joining materials of differing metallurgy via heat. Because the brazing process is traditionally performed by a human, there is potential for human error and impurities presented in the braze material (e.g., metal solder), which may result in the loss of cutters 112 when the drill bit 100 is placed in use and otherwise exposed to downhole drilling conditions. To ensure a consistent braze, operators will often utilize some method or means of holding the cutter 112 in place during the brazing process. However, despite such an attempt to retain the cutter 112 in place, the cutters 112 may tend to "float" within the pockets 114 while the braze is being applied. In such instances, upon cooling, the cutter 112 may not be secured or seated as originally designed within the pocket 114. Such an anomaly may leave the cutter 112 susceptible to both damage and loss.

Downhole drilling conditions, including flow rates, axial forces, heavy vibration, and erosion, will inevitably lessen the life of the cutters 112. In some cases, drilling conditions and parameters may cause the cutters 112 to be dislodged from their respective pockets 114 during drilling operation. A gap between the bottom surface of the cutter 112 and the pocket 114 may result from poor brazing practices, which can further increase the risk of cutter 112 evacuation and potential downhole loss. A loss of a plurality of the cutters 112 may require the drill bit 100 to be returned to surface for repair or replacement earlier than planned, thus resulting in added time and cost.

According to embodiments of the present disclosure, the cutters 112 secured to the drill bit 100 may include a retention feature that serves to securely hold the cutter 112 in place within both steel and matrix drill bits. The retention features described herein aid in at least two ways. First, the retention features assist in ensuring proper placement and centering of the cutter 112 within the corresponding pocket 114 during brazing operations. The cutters 112 are not prone to "floating" because the retention features eliminate the need for an external retention device during brazing. Retained cutters 112 offer improved quality assurance of the position of the cutter 112 within the drill bit 100, or more particularly, the pocket 114. Second, the retention features disclosed herein help increase the likelihood that the cutter 112 will remain in place even when exposed to extreme downhole drilling conditions. The retention features mitigate risk of premature bit failures due to loss of cutters 112.

Figure 2A:
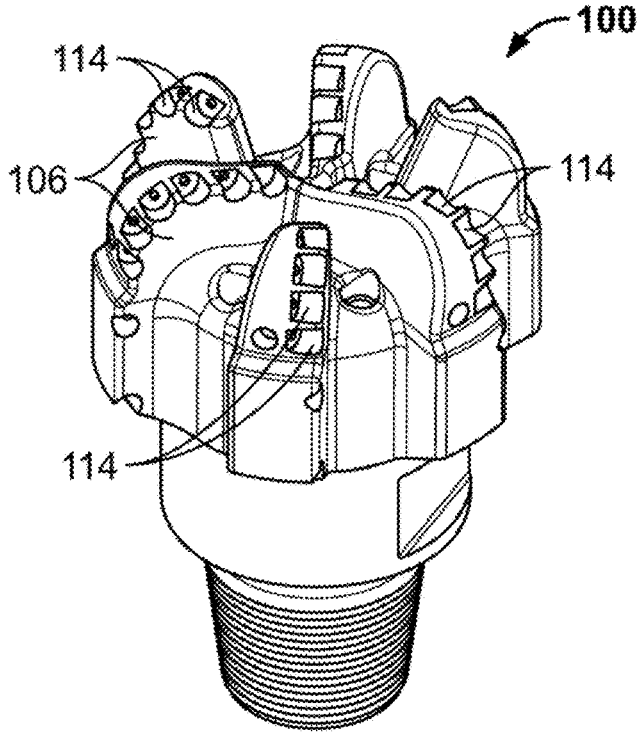
FIG. 2A is a schematic, isometric view of a modified fixed-cutter drill bit, in accordance with the principles of the present disclosure.

FIG. 2A is a schematic, isometric view of the drill bit 100 without the cutters 112 (FIG. 1), according to one or more embodiments. As illustrated, the cutter pockets 114 are defined on the blades 104 at or near the leading face 106 of each blade 104 and may exhibit a generally cylindrical or arcuate shape sized and otherwise configured to receive a corresponding cutter 112. Accordingly, each cutter pocket 114 may exhibit a depth and radius corresponding to the length and diameter of the corresponding cutter 112 to be received therein.

Figure 2B:
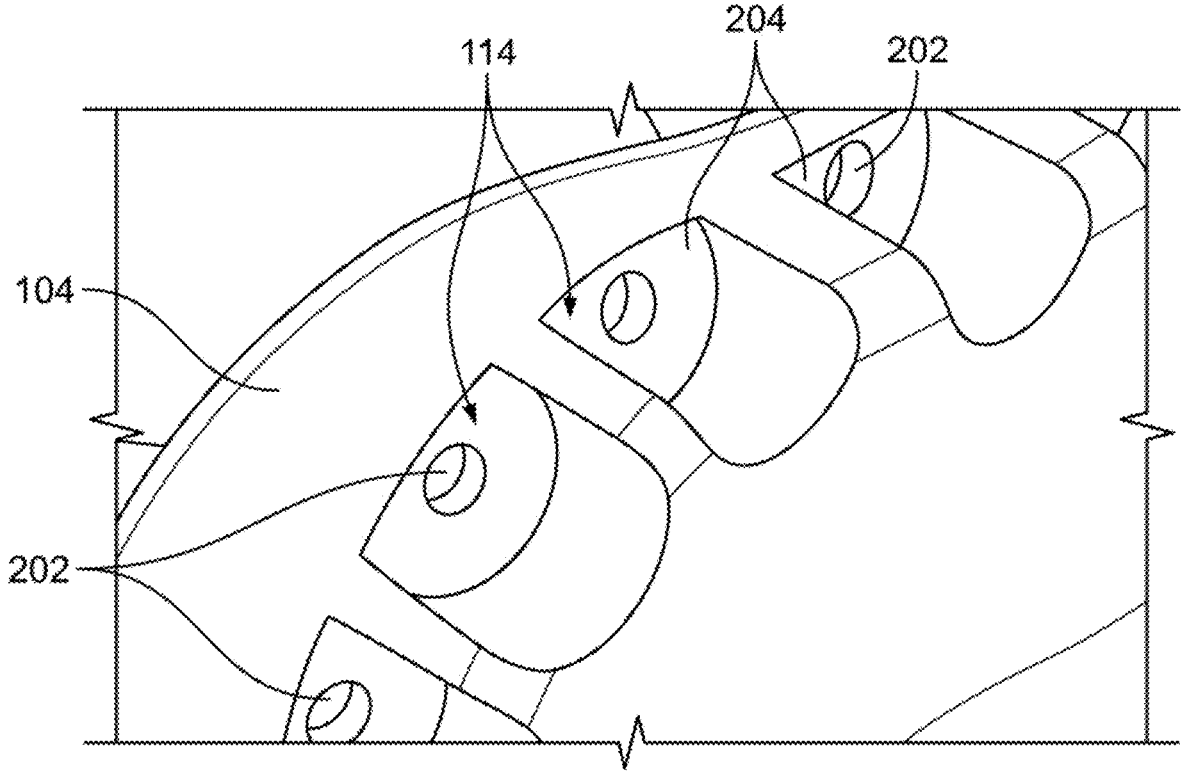
FIG. 2B is an enlarged portion of the modified fixed-cutter drill bit depicted of FIG. 2A.

FIG. 2B is an enlarged, schematic view of a portion of the drill bit 100 of FIG. 2A, according to one or more embodiments. More particularly, FIG. 2B provides an enlarged view of a plurality of the cutter pockets 114 defined within a corresponding one of the blades 104. As illustrated, an orifice 202 is defined at a floor 204 of each cutter pocket 114. The orifices 202 may be defined or formed in the floor 204 in a variety of manufacturing processes, such as milling the orifice 202 into the bit body 102 (FIG. 1). In other embodiments, one or more of the orifices 202 may be formed into the corresponding cutter pocket 114 during the casting process of the bit body 102. In some embodiments, the orifice 202 may be concentrically arranged within the pocket 114, but could alternatively be eccentrically arranged, without departing from the scope of the disclosure.

Each orifice 202 may be configured to receive a retaining feature of a corresponding cutter, which helps to ensure proper placement, retention, and centralization of the cutter within the pocket 114. The orifice 202 will generally exhibit the same cross-sectional shape as the retaining feature, but could alternatively exhibit a dissimilar cross-sectional shape, without departing from the scope of the disclosure. In the illustrated embodiment, for example, the orifices 202 exhibit a generally circular cross-sectional shape, but it is contemplated herein that one or more of the orifices 202 may exhibit other cross-sectional shapes, such as oval, ovoid, or polygonal (e.g., triangular, rectangular, pentagonal, hexagonal, etc.), gear toothed (e.g., castellated), and thereby configured to receive a correspondingly shaped retaining feature.

Figure 3:
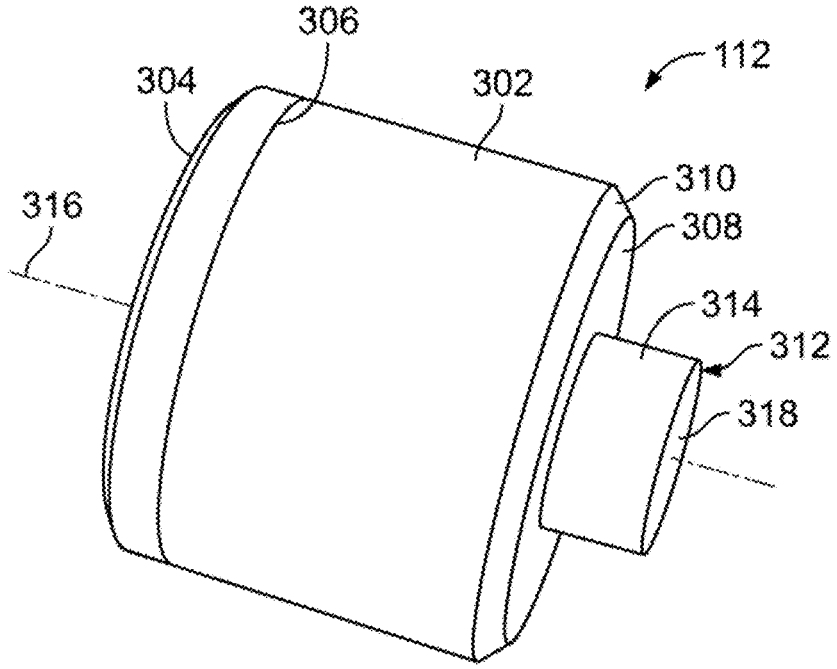
FIG. 3 is an enlarged view of an example modified cutter, according to one or more embodiments of the present disclosure.

FIG. 3 is an enlarged, isometric side view of an example cutter 112 that may employ the principles of the present disclosure. As shown, the cutter 112 may include a generally cylindrical substrate 302 and a diamond table 304 (alternatively referred to as a disk) secured to the substrate 302 at an interface 306 between the substrate 302 and the diamond table 304. The substrate 302 may be made of an extremely hard material, such as tungsten carbide (WC) or a ceramic. In some embodiments, the substrate 302 may comprise a cylindrical WC "blank" that is sufficiently long to act as a mounting stud for the diamond table 304. In other embodiments, the substrate 304 may comprise an intermediate layer bonded at another interface to another metallic mounting stud, without departing from the scope of this disclosure.

The diamond table 304 may incorporate one or more layers of ultra-hard material, including but not limited to polycrystalline diamond (PCD), polycrystalline cubic boron nitride, sintered tungsten carbide, thermally stable polycrystalline (TSP), natural or synthetic diamond, hardened steel, or any combination thereof. Accordingly, the resulting cutter 112 may be characterized and otherwise referred to herein as a "polycrystalline diamond compact" cutter 112 or a PDC cutter 112. The particular composition of the diamond table 304, however, is not limiting to the scope of this disclosure.

The cutter 112 provides a bottom surface 308 opposite the diamond table 304. When the cutter 112 is positioned in a corresponding pocket 114 (FIGS. 1 and 2A-2B) the bottom surface 308 may make physical contact with the floor 204 (FIG. 2B). In at least one embodiment, the substrate 302 may include a beveled edge 310 that provides a transition between the sidewall of the substrate 302 and the bottom surface 308. In another embodiment, the beveled edge 310 may be replaced with a radius (e.g., arcuate length) that transitions to the bottom surface 308. The substrate 302 may include any edge desirable and operable to transition to the bottom surface 308 without limiting the scope of this disclosure.

According to embodiments of the present disclosure, the cutter 112 further includes a retention feature 312 extending from the bottom surface 308. As illustrated, the retention feature 312 comprises a generally cylindrical body 314. In some embodiments, the body 314 may be concentrically arranged with a central axis 316 of the cutter 112. In other embodiments, however, the body 314 may be eccentric to the central axis 316, without departing from the scope of the disclosure. The body 314 may be in the form of a pin or axial protrusion (projection) that extends along (or eccentric to) the central axis 316.

The retention feature 312 may extend from the bottom surface 308 and along the central axis 316. In some embodiments, the retention feature 312 may form an integral part or extension of the material of the substrate 302. In such embodiments, the retention feature 312 may be formed from and otherwise milled out of a portion of the substrate 302. In other embodiments, however, the retention feature 312 may comprise a separate component part operatively and fixedly attached to the bottom surface 308, without departing from the scope of the disclosure.

The body 314 is sized and configured to be received within a corresponding orifice 202 (FIGS. 2A-2B) defined within a corresponding cutter pocket 114 (FIGS. 1 and 2A-2B). As such, the body 314 may exhibit substantially similar dimensions (e.g., depth, diameter, etc.) and shape as the corresponding orifice 202. In particular, the body 314 shown in FIG. 3 exhibits a substantially circular cross-sectional shape. In such embodiments, the corresponding orifice 202 would also exhibit a circular cross-sectional shape slightly larger than and configured to receive the body 314. However, in other embodiments, the body 314 and the corresponding orifice 202 may alternatively exhibit other cross-sectional shapes including, but not limited to, oval, ovoid, polygonal (e.g., triangular, rectangular, pentagonal, hexagonal, etc.), or gear toothed (e.g., castellated), or other mechanical locking mechanisms (e.g., bayonet mount, bayonet fitting, twist-lock, rotary lock, keyed slot mechanism, cam lock or snap fit with rotation, etc.), without departing from the scope of the disclosure.

Having a similar cross-sectional shape for the body 314 and the corresponding orifice 202 may prove advantageous in rehabilitating a drill bit. More specifically, drill bits are often rehabilitated by removing and rotating a cutter 112 within the cutter pocket 114 so that an unused (less-used) edge of the cutter 112 may be exposed. When it is desired to rehabilitate a drill bit, the cutter 112 may be removed from the corresponding pocket 114, rotated a predetermined angular magnitude (e.g., 45°), and re-installed in the pocket 114 for future use. By rotating the cutter 112, a less-used portion of the diamond table 304 may be aligned to engage the underlying rock during operation, thus prolonging the useful life of the cutter 112 and the drill bit.

In embodiments where the body 314 exhibits a circular cross-sectional shape, a diameter of the body 314 may be about 50% or less than a diameter of the substrate 302. In other embodiments where the body 314 exhibits a circular cross-section shape, a diameter of the body 314 may be about 80% or less than a diameter of the substrate 302. Accordingly, the diameter of the body 314, may be some percentage of the diameter of the substrate 302, without exceeding the scope of this disclosure. Moreover, the retention feature 312 defines a bottom face 318 that extends in a plane that is substantially parallel with a plane extending through the bottom surface 308 of the substrate 302. In other embodiments, the bottom face 318 may extend and a plane that is nonparallel to the plane extending through the bottom surface 308.

Figure 4:
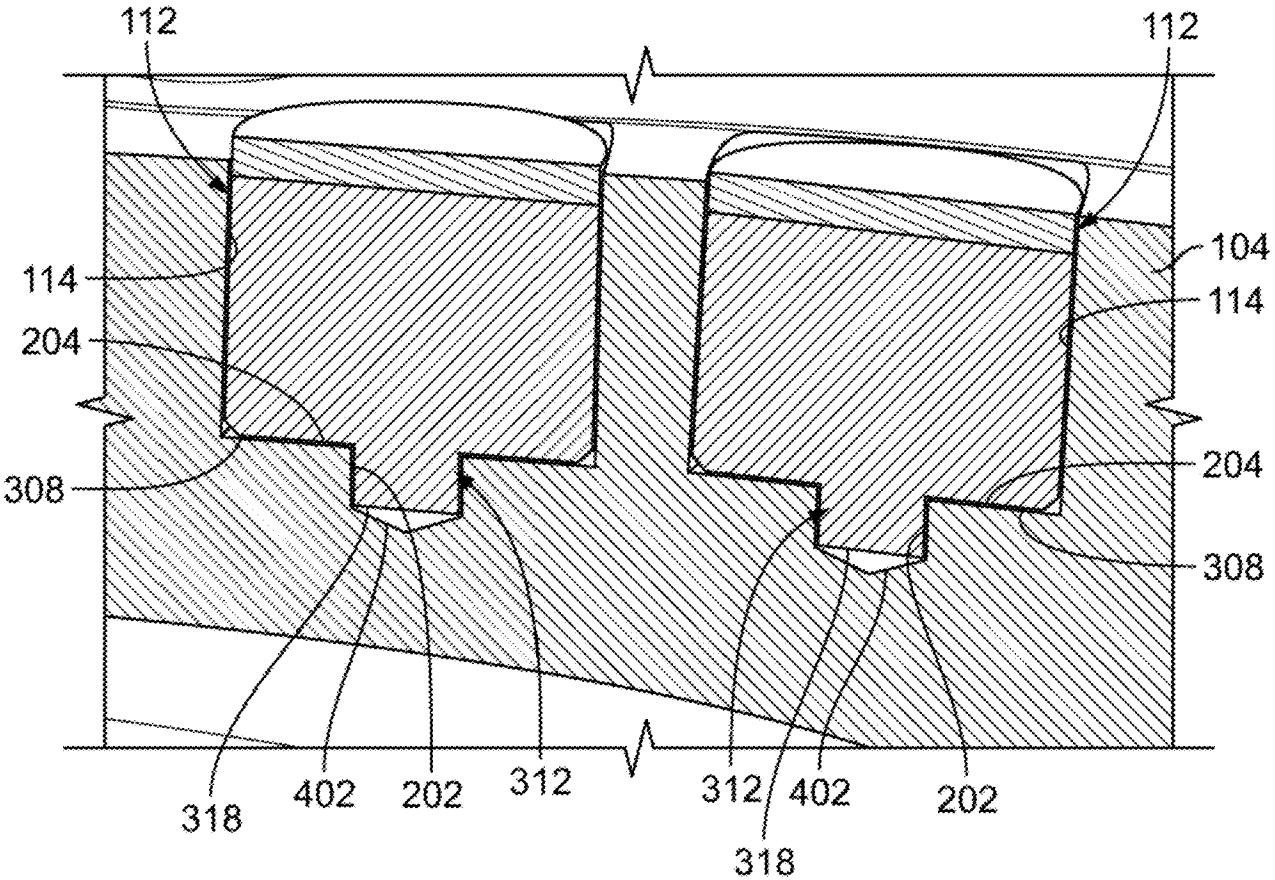
FIG. 4 is an enlarged view, partial schematic of a portion of a modified fixed-cutter drill bit according to one or more embodiments of the present disclosure.

FIG. 4 is an enlarged, cross-sectional side view of a portion of the drill bit 100 of FIG. 1, according to one or more embodiments. More specifically, FIG. 4 shows two cutters 112 positioned and otherwise arranged within corresponding pockets 114 defined in a given blade 104. For installation, the cutters 112 are advanced into the corresponding cutter pocket 114 until the bottom face 318 is brought into close contact or engagement with the floor 204 of the corresponding cutter pocket 114. Moreover, advancing the cutter 112 into the corresponding cutter pocket 114 also advances the retention feature 312 in the same direction to be received within a corresponding orifice 202. Advancing the retention feature 312 into the corresponding orifice 202 may help properly align the cutter 112 within the pocket 114. Accordingly, the retention feature 312 may operate as a type of alignment feature in addition to aiding in cutter 112 retention.

The cutter 112 may be advanced into the corresponding cutter pocket 114 such that the bottom face of the retention feature 312 rests against or is within close proximity to a distal end 402 of the orifice 202. In at least one embodiment, the bottom face 318 may be within several thousandths of an inch of the distal end 402 of the orifice 202. In other embodiments, the bottom face 318 may be completely flush with the distal end 402 of the orifice 202.

In some embodiments, the retention feature 312 may be received within the corresponding orifice 202 via an interference fit. In other embodiments, however, the retention feature may be loosely received within the corresponding orifice 202.

As discussed above, the most common method of securing (attaching) cutters 112 within corresponding pockets 114 is brazing. The retention feature 312 may prove advantageous in helping to eliminate the need for any external application of force to hold the cutter 112 in place during brazing. Rather, the retention feature 312 is mechanically retained within the orifice 202 such that the cutter 112 is held in place (stationary) during the attachment (brazing) process. Similarly, because the orifice 202 is mechanically defined within the interior of the pocket 114, the retention feature 312 centers the cutter 112 with the pocket 114. Centralization of the cutter 112 may be beneficial in aligning the cutter 112 to the desired backrake angle and creates optimal braze joint thickness.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A drill bit, comprising:

a bit body;

one or more blades forming part of the bit body;

a plurality of cutter pockets defined in the one or more blades, each cutter pocket providing a floor and an orifice defined in the floor; and a plurality of cutters secured with braze to the one or more blades at the plurality of cutter pockets, each cutter including:

a substrate;

a diamond table secured to the substrate at an interface; and a retention feature extending from a bottom surface of the substrate and providing a cylindrical sidewall parallel to a sidewall of the substrate, the retention feature being sized to be received within the orifice of a corresponding one of the plurality of cutter pockets, wherein the cylindrical sidewall extends at a constant first diameter between the bottom surface of the substrate and a bottom face of the retention feature, the bottom face being perpendicular to the cylindrical sidewall, and wherein the constant first diameter is smaller than a diameter of the sidewall of the substrate.

2. The drill bit of claim 1, wherein the retention feature comprises a cylindrical body extending concentric with a central axis of the cutter.

3. The drill bit of claim 1, wherein the retention feature comprises an integral extension of the substrate.

4. The drill bit of claim 1, wherein a diameter of the retention feature is 80% or less than a diameter of the substrate.

5. The drill bit of claim 1, wherein the bottom face of the retention feature extends in a plane substantially parallel with a plane extending through the bottom surface of the substrate.

6. The drill bit of claim 1, wherein the retention feature is received within the orifice via an interference fit.

7. The drill bit of claim 1, wherein the retention feature is loosely received within the orifice.

8. The drill bit of claim 1, wherein each cutter is received within a corresponding one of the plurality of cutter pockets such that the bottom face abuts against at least a portion of a distal end of the orifice.

9. The drill bit of claim 1, wherein a portion of the sidewall of the substrate extends above a top face of the blade, and wherein the orifice is entirely defined in the floor below the top face of the blade.

10. A method of securing a cutter to a cutter pocket of a drill bit, comprising receiving the cutter in the cutter pocket, the cutter including:

a substrate;

a diamond table secured to the substrate at an interface; and a retention feature extending from a bottom surface of the substrate and providing a cylindrical sidewall parallel to a sidewall of the substrate;

centering the cutter within the cutter pocket by receiving the retention feature in an orifice defined in a floor of the cutter pocket; and attaching the cutter in the cutter pocket with braze while the retention feature is received within the orifice, wherein the cylindrical sidewall of the retention feature extends at a constant first diameter between the bottom surface of the substrate and a bottom face of the retention feature, the bottom face being perpendicular to the cylindrical sidewall of the retention feature, and wherein the constant first diameter is smaller than a diameter of the sidewall of the substrate.

11. The method of claim 10, further comprising holding the cutter in place during attaching with the retention feature received within the orifice.

12. The method of claim 10, further comprising preventing floating of the cutter within the cutter pocket during attaching with the retention feature received within the orifice.

13. The method of claim 10, wherein receiving the cutter in the cutter pocket is preceded by milling the orifice into the floor of the cutter pocket.

14. A method of manufacturing a cutter for a drill bit, comprising:

securing a diamond table to a first end of a substrate; and providing a retention feature on a second end of the substrate opposite the first end, wherein the retention feature comprises a body and a sidewall parallel to a sidewall of the substrate and extends at a constant first diameter between the bottom surface of the substrate and a bottom face of the retention feature, the bottom face being perpendicular to the sidewall of the retention feature, wherein the constant first diameter is smaller than a diameter of the sidewall of the substrate, the retention feature being sized to be received within an orifice defined in a floor of a cutter pocket of the drill bit, wherein the cutter is configured to be secured with braze to the cutter pocket along at least a portion of the sidewall of the substrate.

15. The method of claim 14, wherein the body exhibits a cross-sectional shape selected from the group consisting of circular, oval, ovoid, polygonal, gear-toothed, and any combination thereof.

16. The method of claim 14, wherein providing the retention feature on the second end comprises aligning the body concentric with a central axis of the cutter.

17. The method of claim 14, wherein providing the retention feature on the second end comprises forming the retention feature on the second end as integral extension of the substrate.

18. The drill bit of claim 14, wherein the cutter pocket is defined in a blade of the drill bit, and wherein the portion of the sidewall of the substrate extends above a top face of the blade, and wherein the orifice is entirely defined in the floor below the top face of the blade.

19. The drill bit of claim 14, wherein the portion of the sidewall of the substrate is located above a top of the orifice.

20. A method of retrofitting a drill bit, comprising forming an orifice defined in a floor of a cutter pocket;

receiving a cutter in the cutter pocket, the cutter including:

a substrate;

a diamond table secured to the substrate at an interface; and a retention feature extending from a bottom surface of the substrate and providing a cylindrical sidewall parallel to a sidewall of the substrate, wherein the cylindrical sidewall of the retention feature exhibits a constant first diameter between the bottom surface of the substrate and a bottom face of the retention feature, the bottom face being perpendicular to the cylindrical sidewall, wherein the constant first diameter is smaller than a diameter of the sidewall of the substrate;

centering the cutter within the cutter pocket by receiving the retention feature in the orifice, wherein the bottom surface contacts the floor when the retention feature is received within the orifice; and attaching the cutter in the cutter pocket with braze while the retention feature is received within the orifice.

* * * * *